US010555564B2

(12) United States Patent
Brady et al.

(10) Patent No.: US 10,555,564 B2
(45) Date of Patent: Feb. 11, 2020

(54) PANTS WITH BIASING CROTCH OPENING

(71) Applicant: Tania Brady, Englewood, FL (US)

(72) Inventors: Tania Brady, Englewood, FL (US); Margaret Robustelli, Wilton, CT (US)

(73) Assignee: Tania Brady, Englewood, FL (US)

( * ) Notice: Subject to any disclaimer, the term of this patent is extended or adjusted under 35 U.S.C. 154(b) by 75 days.

(21) Appl. No.: 15/641,692

(22) Filed: Jul. 5, 2017

(65) Prior Publication Data

US 2018/0007979 A1 Jan. 11, 2018

Related U.S. Application Data

(60) Provisional application No. 62/358,724, filed on Jul. 6, 2016.

(51) Int. Cl.

| | |
|---|---|
| ***A41B 9/04*** | (2006.01) |
| ***A41C 1/00*** | (2006.01) |
| ***A41D 1/06*** | (2006.01) |
| ***A41B 9/00*** | (2006.01) |
| ***A41D 1/22*** | (2018.01) |

(52) U.S. Cl.

CPC ..... *A41D 1/065* (2013.01); *A41B 9/005* (2013.01); *A41D 1/22* (2013.01)

(58) Field of Classification Search

CPC ..... A41D 1/065; A41D 1/22; A41B 9/004; A41B 9/005; A41B 9/04

USPC ..... 2/78.2, 78.3, 406–408; 450/105, 450/122–125

See application file for complete search history.

(56) References Cited

U.S. PATENT DOCUMENTS

| | | | | | |
|---|---|---|---|---|---|
| 2,476,585 | A | * | 7/1949 | Cohen | A41C 1/02 2/406 |
| 2,522,009 | A | * | 9/1950 | Wohlman | A41C 1/003 2/408 |
| 2,812,516 | A | * | 11/1957 | Hoffman | A41B 13/04 2/227 |
| 3,040,751 | A | * | 6/1962 | Mastenbrook | A41C 1/003 450/105 |
| 3,224,448 | A | | 4/1963 | Diebold | |
| 3,208,455 | A | * | 9/1965 | Fridolph | A41C 1/00 450/105 |
| 3,398,739 | A | | 5/1966 | Marino | |
| 3,486,507 | A | * | 12/1969 | Bregenzer et al. | A41B 9/04 2/401 |
| 3,823,721 | A | * | 7/1974 | Herbener | A41B 9/005 2/406 |
| 4,301,550 | A | * | 11/1981 | Carver | A41B 9/005 2/408 |
| 5,014,364 | A | * | 5/1991 | Orr | A41B 11/14 2/408 |
| 5,093,932 | A | * | 3/1992 | Doyle | A41D 13/1263 2/114 |

(Continued)

*Primary Examiner* — Jameson D Collier
(74) *Attorney, Agent, or Firm* — Kenneth C. Spafford

(57) ABSTRACT

Pants with novelty crotch opening. The pants include leg encircling portions and a crotch area with two overlapping panels that bias toward a closed position. Each panel includes a free edge that is pulled laterally to place the crotch area in an open position. When the crotch area is not being held open or has no interposing object holding it open, the crotch area immediately returns to a closed position. The crotch panel does not include fasteners such as buttons or snaps and to an outside observer does not appear to have an opening.

17 Claims, 8 Drawing Sheets

(56) References Cited

U.S. PATENT DOCUMENTS

| | | | | |
|---|---|---|---|---|
| 6,324,699 | B1 | 12/2001 | Cosmah | |
| 7,100,214 | B1 | 9/2006 | Murray | |
| 2008/0222770 | A1 | 9/2008 | Oates | |
| 2010/0269243 | A1 | 10/2010 | Paree | |
| 2012/0060264 | A1 | 3/2012 | Wilkins | |
| 2012/0084898 | A1 | 4/2012 | Cronan | |
| 2013/0104294 | A1 | 5/2013 | Edwards | |
| 2014/0196193 | A1* | 7/2014 | Namy | A41D 1/065 2/227 |
| 2014/0221885 | A1* | 8/2014 | Fleschere | A41B 9/04 601/46 |
| 2015/0007379 | A1* | 1/2015 | Cockram | A41D 1/06 2/236 |

* cited by examiner

PANTS WITH BIASING CROTCH OPENING

CROSS-REFERENCE TO RELATED APPLICATIONS

This application claims the benefit of provisional Application No. 62/358,724, filed Jul. 6, 2016.

STATEMENT REGARDING FEDERALLY SPONSORED RESEARCH OR DEVELOPMENT

Not Applicable.

BACKGROUND

1. Field of Invention

This invention pertains to pants. More particularly, this invention pertains to women's pants that allow the wearer to engage in sexual intercourse or have a gynecological exam while fully clothed, without the use of snaps, buttons, zippers, hook-and-loop, or other fasteners.

The pants include a flexible crotch opening that biases in a closed position regardless of the wearer's stance or body position. However, once the crotch portion is pulled into an open position and the wearer is engaged in sexual intercourse, the crotch portion easily maintains its open position without the wearer or the wearer's partner needing to hold the crotch portion open. The crotch portion is configured to feel to the wearer's partner like a physical extension of the wearer.

2. Description of the Related Art

There is related prior art clothing for women designed to allow the wearer to urinate without removing the clothing. However, this prior art is not optimal for allowing the wearer to engage in discreet sexual intercourse while fully clothed.

U.S. Pat. No. 7,100,214, titled "Article of Clothing With a Crotch Portion Positionable Between Open and Closed Positions," by Murray, discloses an article of clothing with a crotch portion that can be opened. The crotch portion includes an overlapping first and second flap that are held together with buttons or other fasteners. Murray's invention is for use by women who need to urinate without removing their clothing, for example when it is cold outside or during outdoor athletic events when there is no restroom readily available. While Murray's pants may work well for their intended purpose, they would not be useful as pants for discreet sexual intercourse. Murray's fasteners would take time to open and close and would cause discomfort to the wearer's partner.

Patent application publication 2010/0269243, titled "Pant Garment Having an Opening for Female Urination," by Paree, discloses pants with a flap frame in the crotch portion. The flap frame has overlying flaps that the wearer pulls apart to allow the wearer to urinate while in a front stance position. While Paree's invention may work for its intended purpose, it would not be useful for sexual intercourse. Paree's flaps are overlapped too great an extent and would cause extreme discomfort to the wearer's sexual partner, unless the flaps were manually held open during intercourse.

BRIEF SUMMARY

According to one embodiment of the present invention, a pair of pants with a flexible crotch opening is provided. The pants include a body-encircling portion having a right leg portion, a left-leg portion, and a crotch portion.

In one embodiment, the crotch portion is kite-shaped and has a perimeter that encircles at least the entrance portion of the wearer's external vaginal area. The crotch portion is positionable between open and closed positions.

The crotch portion includes a first cover and a second cover, each of which are attached to the crotch portion perimeter. The first cover and the second cover each have a free edge. When the crotch portion is in a closed position, the first and second covers overlap one another to form a covering of the external vaginal area of the wearer. Neither free edge intersects the centerline of the external vaginal area of the wearer.

The crotch portion biases in a closed position regardless of the position of the wearer. Thus, the crotch portion covers the wearer completely even when a wearer is running, stretching, sitting spread-legged, or doing yoga.

In another embodiment, the crotch biases to a closed position during normal activities such as walking or sitting. The crotch edges are configured to spread apart sufficiently to allow for a gynecological exam, e.g., examination with the use of a speculum, without requiring removal of the pants.

In one embodiment, the crotch portion does not include any fasteners, such as zippers, snaps, or a hook and loop fastening system.

The crotch portion is placed in an open position by pulling apart the free edges of the first and second covers. Once the crotch portion is in an open position, a member inserted into the wearer's vaginal opening will be sufficient to hold the crotch in an open position. The first and second covers press against the member with a force and pressure configured to feel like an extension of the wearer's vagina. In one embodiment, the internal lining of the first and second covers are soft and smooth material, such as thin fleece.

In one embodiment, the pants are made of a uniform material. In one embodiment, the pants are yoga pants. In one embodiment, the pants are made of a combination of polyester and spandex.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus for discreet sexual intercourse is disclosed. The pants are generally indicated as 100. Certain elements, such as crotch panels 102, include a right-side designation 102-R or left-side designation 102-L. Other elements, such as the sides 406 of crotch opening 150, include both upper/lower and right/left designations, e.g., 406-UR, 406-UL, 406-LR, and 406-LL.

In the illustrated embodiments, the apparatus is shown as full-length pants 100. However, other embodiments include shorts, jeans, slacks, tights, body-suits, bathing suits, leotards, foundation garments, panty hose, and costumes.

Figure 1:
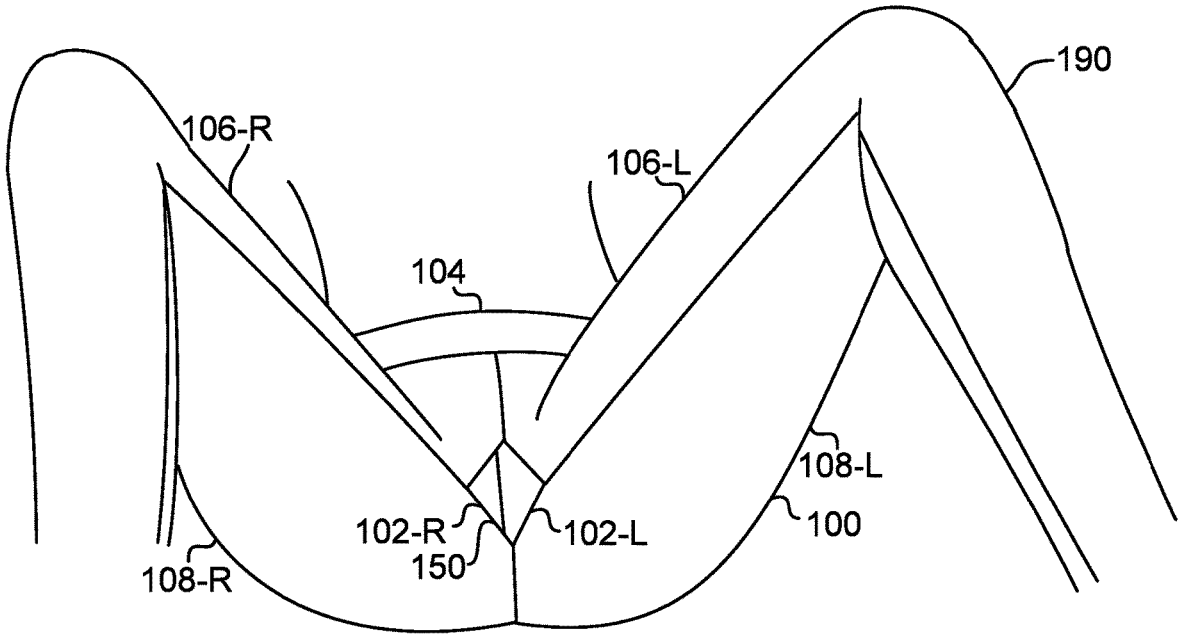
FIG. 1 is a front view of a user wearing one embodiment, with the user in a sitting position with the user's legs spread open.

FIG. 1 shows a wearer 190 wearing pants 100, which includes front leg pieces 106-R, 106-L, back leg pieces 108-R, 108-L, waist band front piece 104, and crotch panels 102-R and 102-L. Right leg pieces 106-R, 108-R collectively encircle the right leg of the wearer. Left leg pieces 106-L, 108-L collectively encircle the left leg of the wearer. Right and left leg pieces 106-R, 108-R, 106-L, 108-L collectively encircle the wearer's body. All pieces of the pants 100 are made of the same stretchable material, for example, a combination of 92% polyester and 8% spandex. In other embodiments, some pieces are made of a different material for ornamental or functional purposes.

Front leg pieces 106-R, 106-L and back leg pieces 108-R, 108-L are configured to join in a manner to define crotch area 150. Crotch area 150 is kite-shaped. Due to the elastic nature of the material used in the pants, in some embodiments the crotch area 150 is substantially kite-shaped even if crotch area 150 does not define a kite with perfectly straight edges. Left crotch panel 102-L overlaps right crotch panel 102-R. Left and right crotch panel 102-L, 102-R bias to a closed position. As shown in FIG. 1, crotch panels 102-L, 102-R completely cover crotch area 150 even when the wearer 190 is in a spread-legged position.

Figure 2:
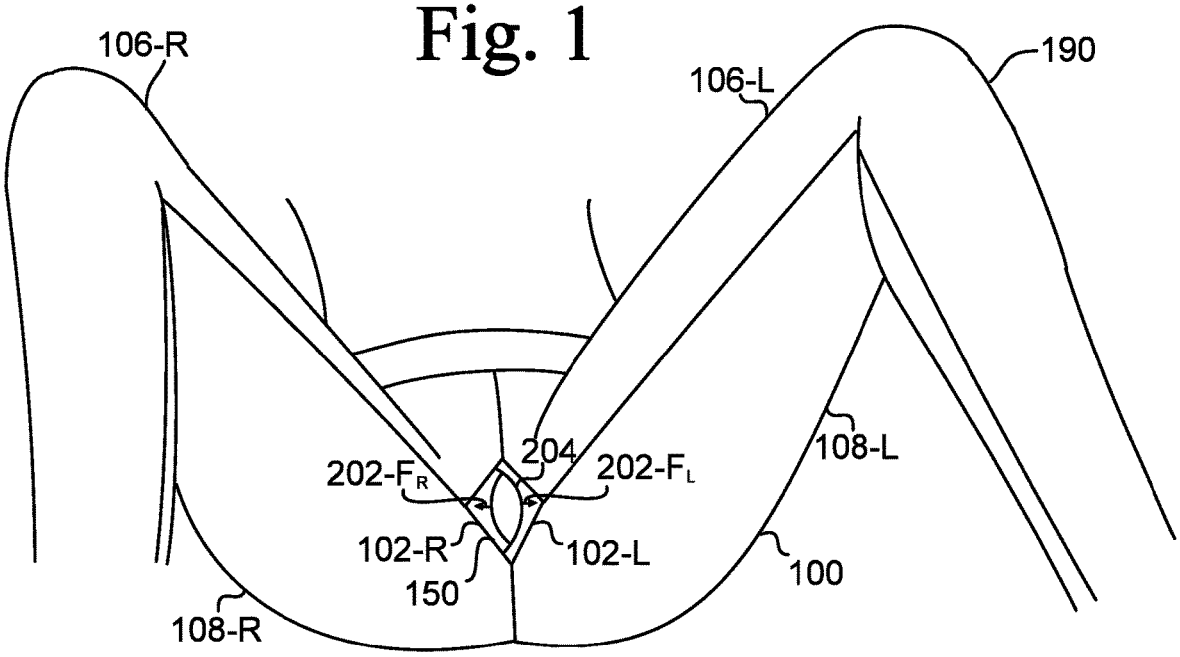
FIG. 2 is the same front view as FIG. 1, with the embodiment's crotch held in an open position.

FIG. 2 displays the pants with the crotch area 150 in an open position. Left crotch panel 102-L is pulled to the left at 202-$F_L$ and right crotch panel 102-R is pulled to the right at 202-$F_R$, creating opening 204 and exposing the wearer's 190 vaginal entrance.

Figure 3:
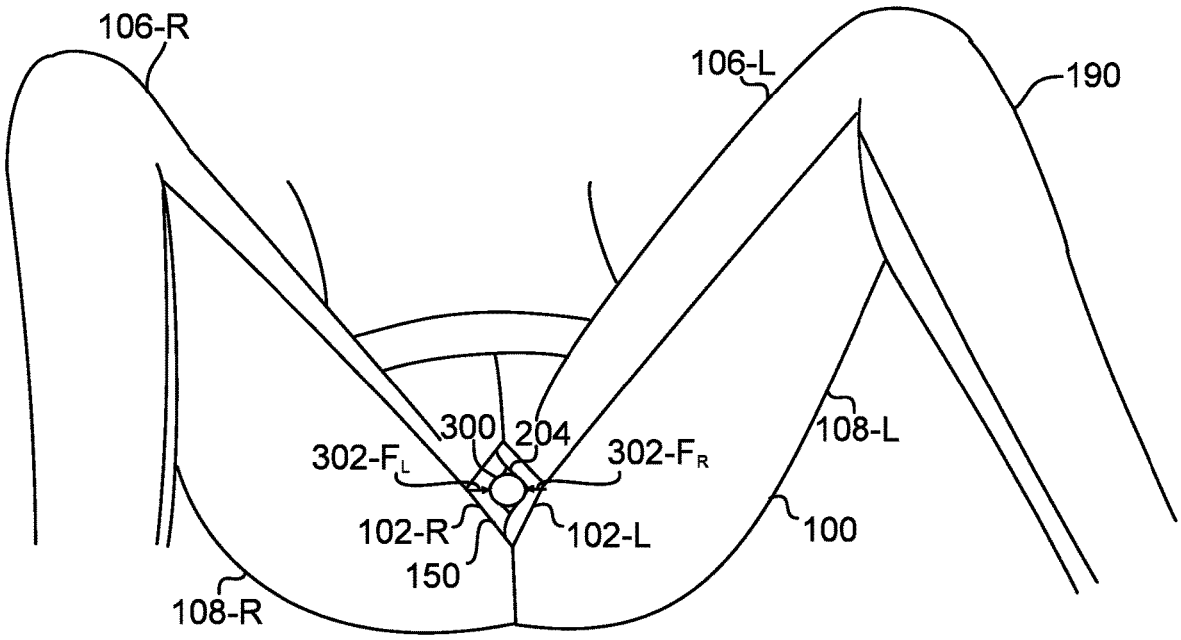
FIG. 3 is the same front view as FIG. 1, during use with the wearer's partner.

FIG. 3 displays the pants configuration when the wearer 190 engaged in sexual intercourse in the sitting position of FIGS. 1 and 2. The sitting position of wearer 190 in FIG. 3 is not limiting, as the pants 100 are operable to be used in other positions, which do not require elaboration. Once member 300 is inserted, left crotch panel 102-L right crotch panel 102-R press against member 300 with respective forces 302-$F_R$ and 302-$F_L$, thereby reducing the size of opening 204 and limiting the exposure of the wearer 190. Free edges 402-L, 502-R become defined by member 300, thereby further limiting the wearer's 190 exposure. Because crotch panels 102-L, 102-R do not require a great amount of distention to allow for member 300, forces 302-$F_R$ and 302-$F_L$ are not so great as to cause discomfort or impediment to the wearer's 190 partner. Forces/pressures 302-$F_R$, 302-$F_L$ are sufficiently low so as to not create a static/kinetic friction that would pull a condom off the wearer's partner.

Once member 300 is removed, crotch panels 102-L, 102-R immediately return to their original closed position as shown in FIG. 1, without the wearer 190 needing to take any action such as closing or fastening the crotch panels 102-L, 102-R.

Figure 4:
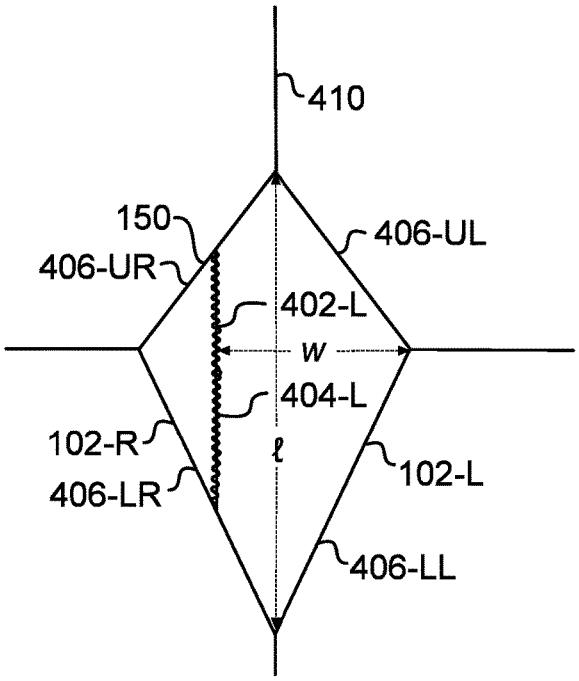
FIG. 4 is a front view of a crotch portion of an embodiment.
Figure 5:
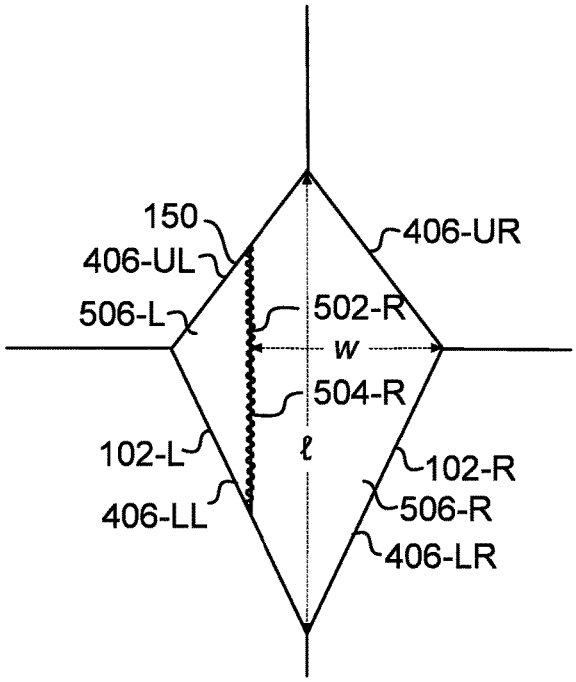
FIG. 5 is an inside view of a crotch portion of an embodiment.

FIG. 4 displays a detailed view of the outside of crotch opening 150, and FIG. 5 displays a detailed view of the inside of crotch opening 150. Crotch opening 150 is kite-shaped and includes upper right side 406-UR, upper left side 406-UL, lower right side 406-LR, and lower left side 406-LL. The ratio of the length l to the width w of each panel 102-L, 102-R is 6 to 2.5. Other embodiments have different length to width ratios.

Left crotch panel 102-L is attached to all of upper left side 406-UL and all of lower left side 406-LL. Left crotch panel 102-L is attached to only a portion of upper right side 406-UR and a portion of lower right side 406-LR. Free edge 402-L extends from upper right side 406-UR to lower right side 406-LR, parallel to the seam 410 joining the front leg pieces 106-R, 106-L.

Right crotch panel 102-R is attached to all of upper right side 406-UR and all of lower right side 406-LR. Right crotch panel 102-R is attached to only a portion of upper left side 406-UL and a portion of lower left side 406-LL. Free edge 502-R extends from upper left side 406-UL to lower left side 406-LL, parallel to the seam 410 joining the front leg pieces 106-R, 106-L.

Free edges 402-L, 502-R are parallel to, and located on either side of, the centerline of the wearer's external vaginal area. Free edges 402-L, 502-R include respective overloop stitching 404-L, 504-R that prevent the edges 402-L, 502-R from rolling or bunching during intercourse. By spacing the free edges 402-L, 502-R from the centerline of the wearer's external vaginal area, the stitching 404-L, 504-R is impeded from entering the labia majora or causing irritation to the sensitive areas of the wearer's external vaginal area.

Left and right panel inner faces are lined with a smooth, soft material 506-L, 506-R that is comfortable for both the wearer and her partner. The material 506-L, 506-R is sufficiently smooth such that the force/pressure 302-$F_R$, 302-$F_L$ will not create a static or kinetic friction of sufficient strength remove a condom from the wearer's partner. In one embodiment, the lining is thin fleece. In one embodiment, the interior of leg portions 106-R, 106-L, 108-R, 108-L are lined with the same smooth, soft material. Free edges 402-L, 502-R are sufficiently flat that, combined with the inner lining 506-L, 506-R, the wearer does not feel the free edges 402-L, 502-R. Free edges 402-L, 502-R are not attached to any fasteners, such as buttons, snaps, or hook-and-loop combinations.

A user of the pants 100 may engage in sexual intercourse without the additional step of getting undressed. In addition, a user is able to cease sexual intercourse at a moment's notice and be fully dressed immediately thereafter. In addition, a user is able to engage in sexual intercourse in cold weather without exposing skin to the elements. A user is able to engage in sexual intercourse without exposing to view any portion surrounding the wearer's crotch area, including the legs, waist, and buttocks.

Figure 6:
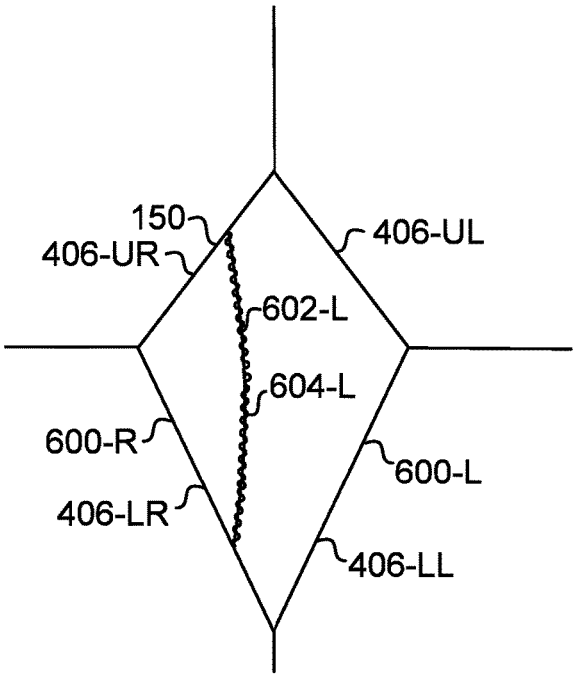
FIG. 6 is a front view of a second variation of a crotch portion of an embodiment.
Figure 7:
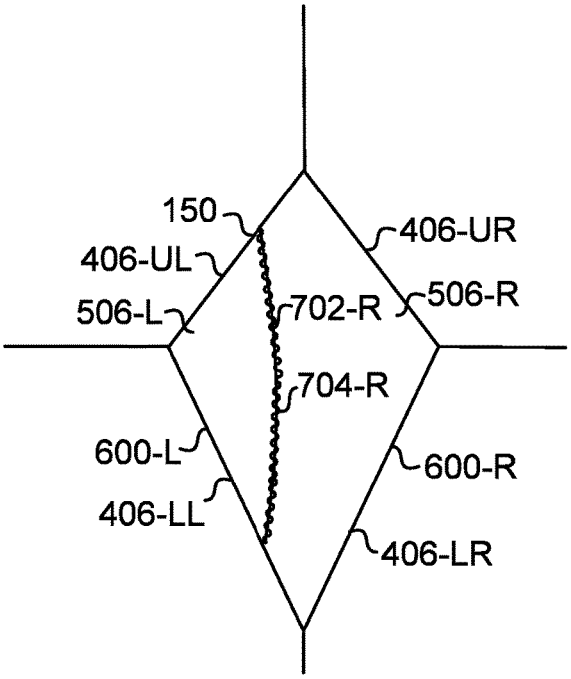
FIG. 7 is an inside view of the second variation of a crotch portion of an embodiment.

FIGS. 6 and 7 displays another embodiment of crotch portion 150. Left panel 600-L free edge 602-L is arcuate and concave in shape with overloop stitching 604-L. Right panel 600-R free edge 702-R is also arcuate and concave in shape and has overloop stitching 704-R. Panels 600-L, 600-R overlap to completely cover the wearer's crotch area. Both panel free edges 702-R and 602-L are displaced from the centerline of, and do not intersect, the wearer's external vaginal area. However, the overlap is least close to the respective center points of free edges 602-L, 702-R, thereby reducing the encircling force/pressure 302-$F_R$, 302-$F_L$ against the wearer's partner when the wearer and her partner are engaged in intercourse.

Figure 8:
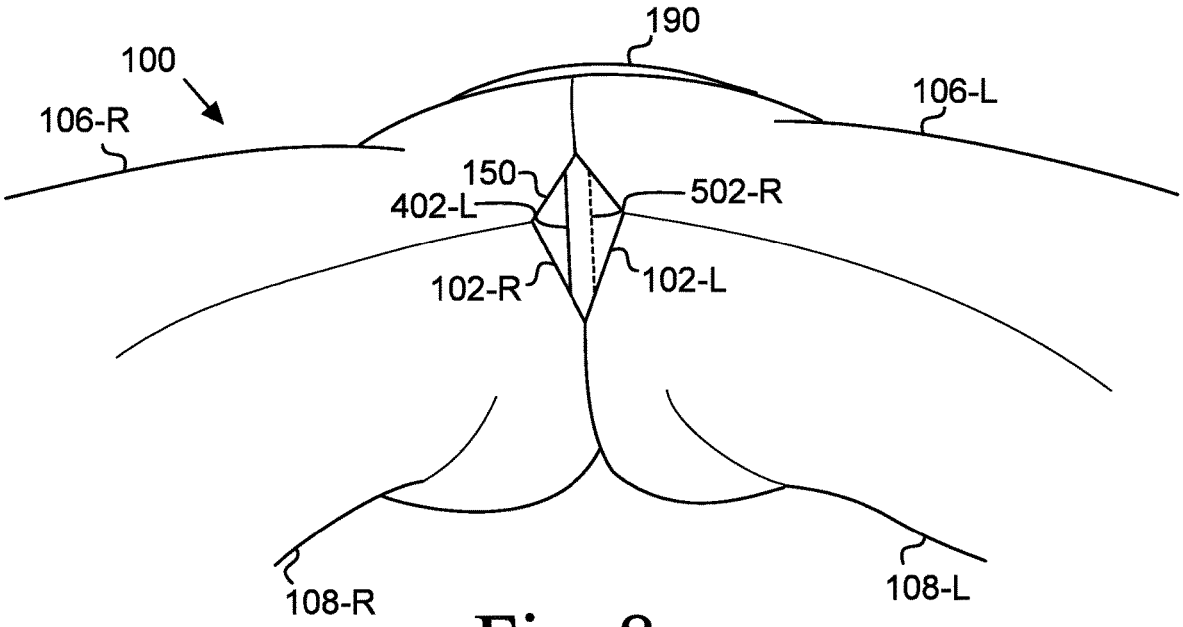
FIG. 8 is bottom view of an embodiment with the wearer standing in an open stance.

FIG. 8 displays the pants 100 being worn in a standing position. Panels 102-R, 102-L maintain a closed position despite the wearer 190 standing spread-legged. Free edges 402-L, 502-R are symmetrical relative to the midline of the wearer 190.

Figure 9:
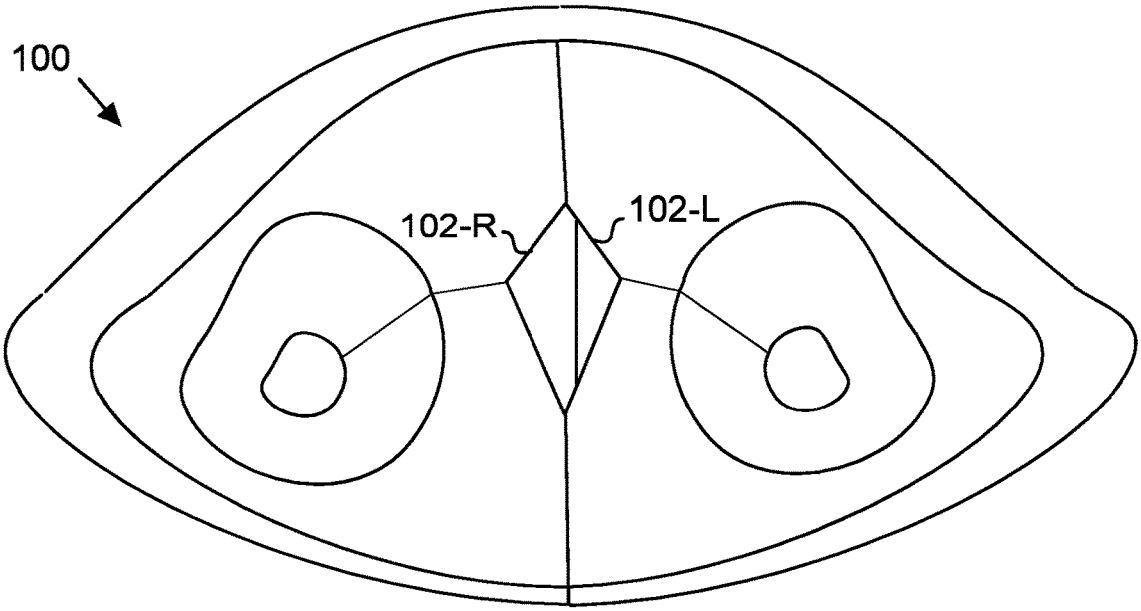
FIG. 9 is a top view of an embodiment.
Figure 10:
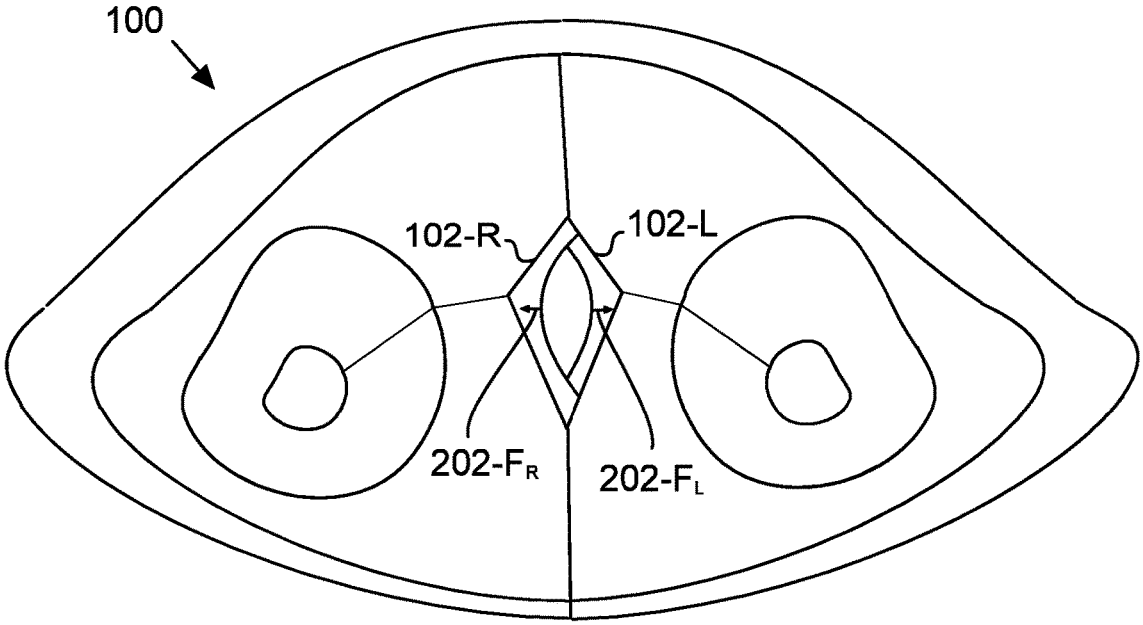
FIG. 10 is a top view of an embodiment, with the crotch portion held in an open position.

FIGS. 9 and 10 illustrates a top inside view of the pants 100 being worn in a standing position. Panels 102-R, 102-L are essentially symmetrical and a mirror image of the outside view seen in FIGS. 1 and 2, whether in a closed position as in FIG. 9 or an open position as in FIG. 10.

Figure 11:
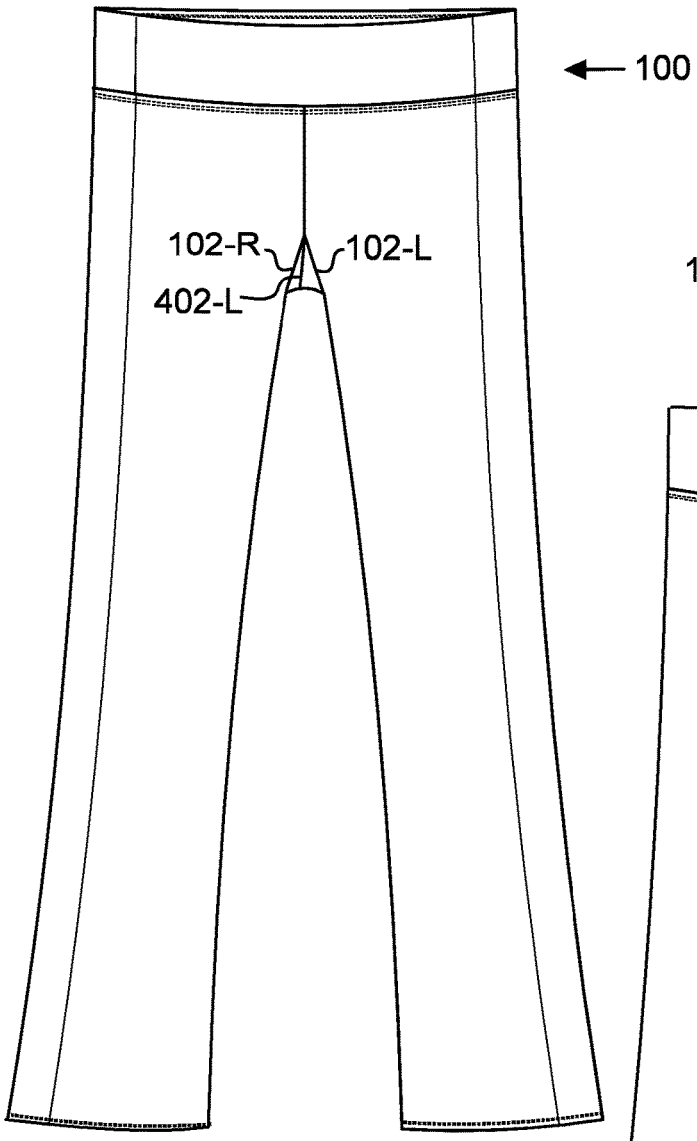
FIG. 11 is a front view of an embodiment.
Figure 12:
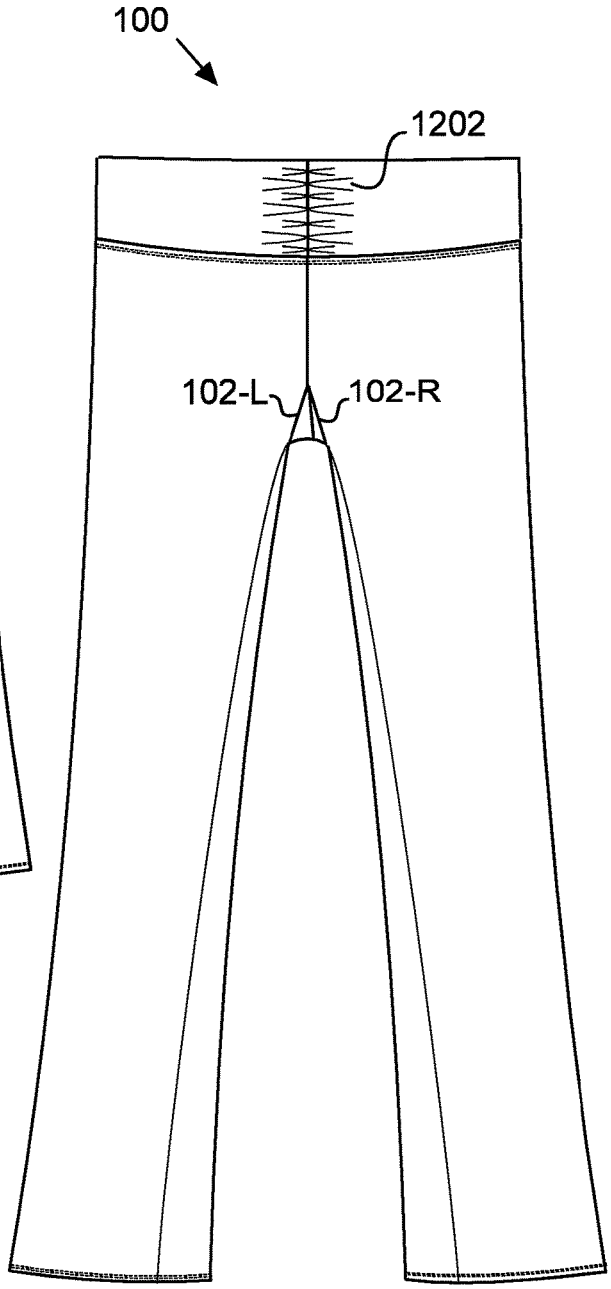
FIG. 12 is a rear view of an embodiment.

FIG. 11 illustrates a front view of the pants 100 in a standing position. FIG. 12 illustrates a rear view of the pants 100 in a standing position. Panels 102-R, 102-L are closed. To an outside observer, crotch area 150 does not even appear to have an opening. The only visible feature on crotch area 150 is left panel free edge 402-L, which presses flat against right panel 102-R. Bunching 1202 is a design feature.

FIGS. 13A-13D show crotch panel and leg pattern pieces for a sample pants embodiment. Modifications of the pieces to accommodate for different shapes and sizes of wearers may be done without limiting the effectiveness of the pant's 100 intended uses. Such modifications will be obvious to those with ordinary skill in the art.

Pattern pieces 13A, 13B, 13C, 13D have notch markings 1300. When two adjacent pieces are properly stitched together, their respective notch markings 1300 are superposed. The top line of the "T" of each notch marking 1300 indicates a stitch line.

Figure 13A:
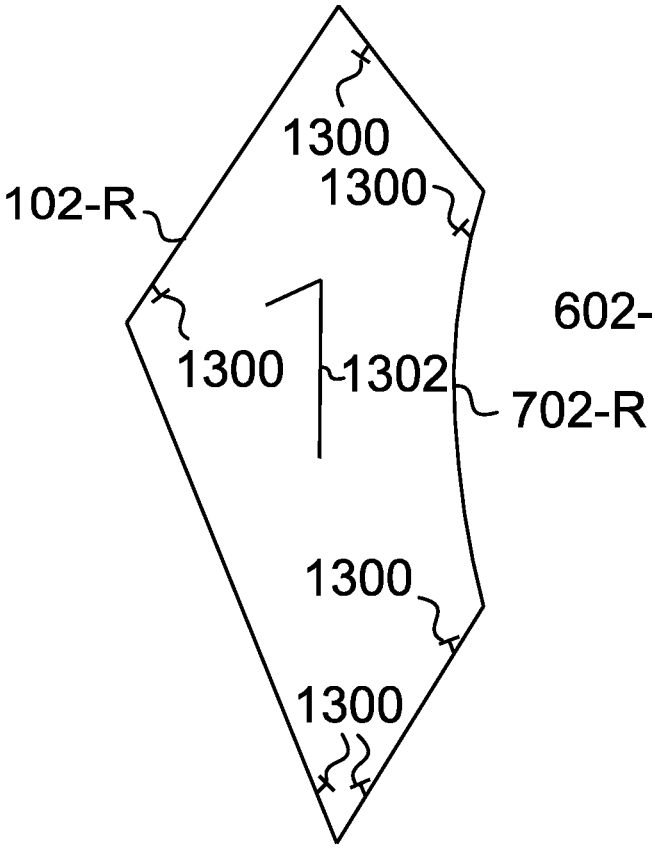
FIG. 13A is a pattern piece for a left crotch panel of an embodiment.
Figure 13B:
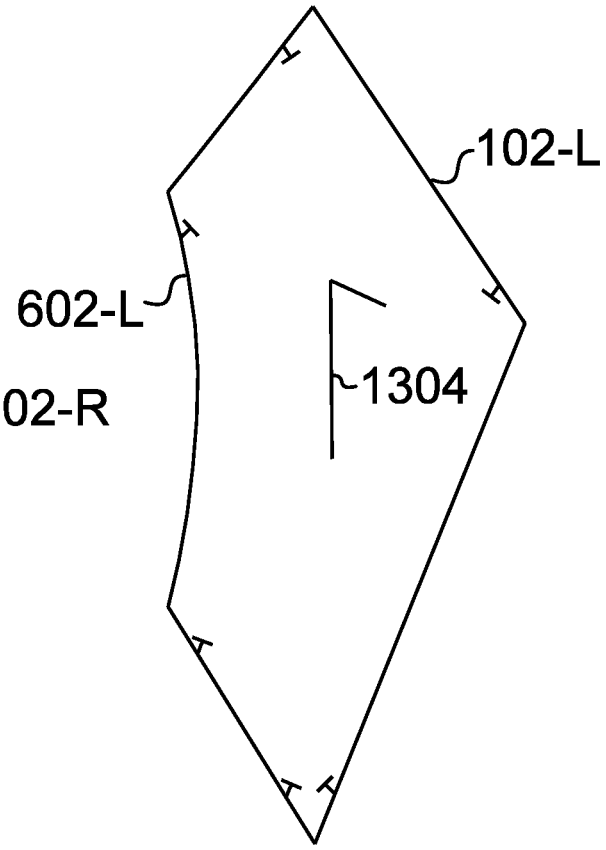
FIG. 13B is a pattern piece for a right crotch panel of an embodiment.
Figure 13C:
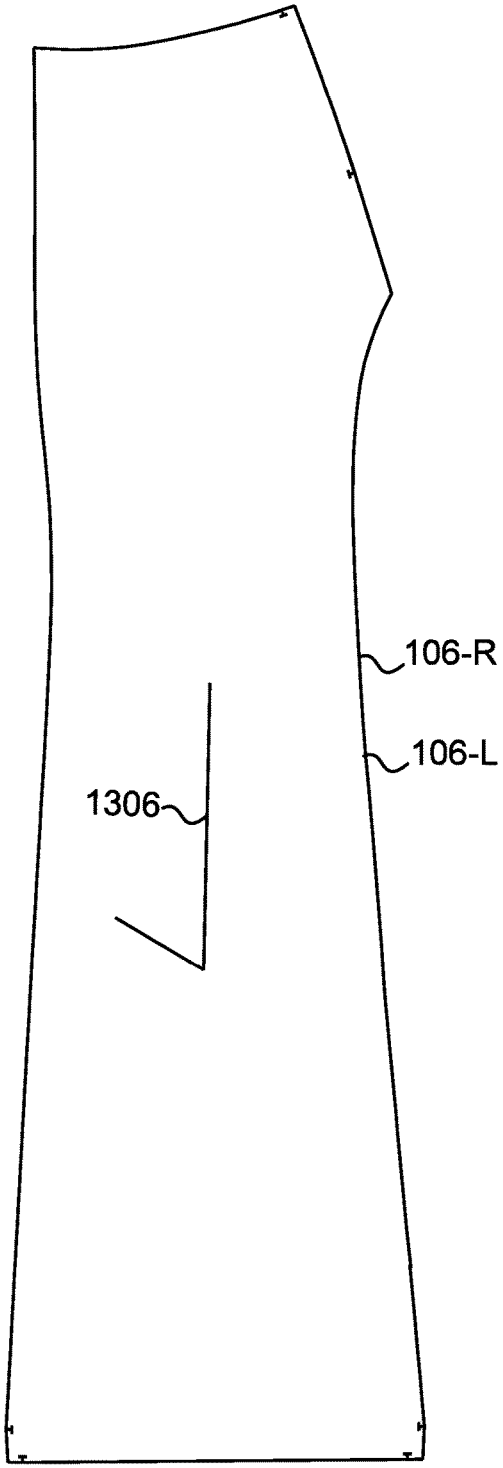
FIG. 13C is a pattern piece for leg fronts of an embodiment.
Figure 13D:
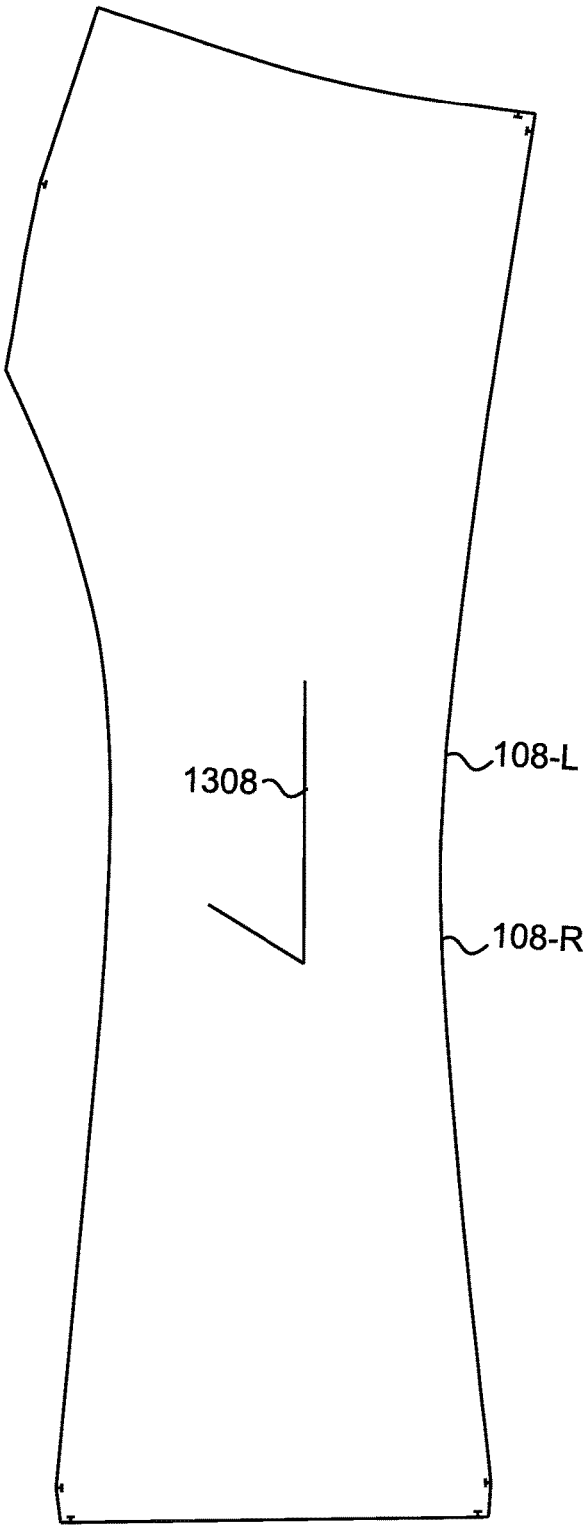
FIG. 13D is a pattern piece for leg backings of an embodiment.

FIG. 13A shows a pattern piece for right crotch panel 102-R. FIG. 13B shows a pattern piece for left crotch panel 102-L. FIG. 13C shows a pattern piece to be used for right and left leg front pieces 106-R, 106-L. FIG. 13D shows a pattern piece to be used for right and left back leg pieces 108-R, 108-L.

When crotch panels 102-L, 102-R and leg pieces 106-R, 106-L, 108-R, 108-L are sewn together, their adjacent portions have grainlines 1302, 1304, 1306, 1308 that are parallel such that the crotch 102 and leg pieces 106, 108 stretch in the same direction. As a result, crotch area 150 is less likely to bunch and disclose any opening 204 unless the wearer holds crotch area 150 in an open position.

Figure 14:
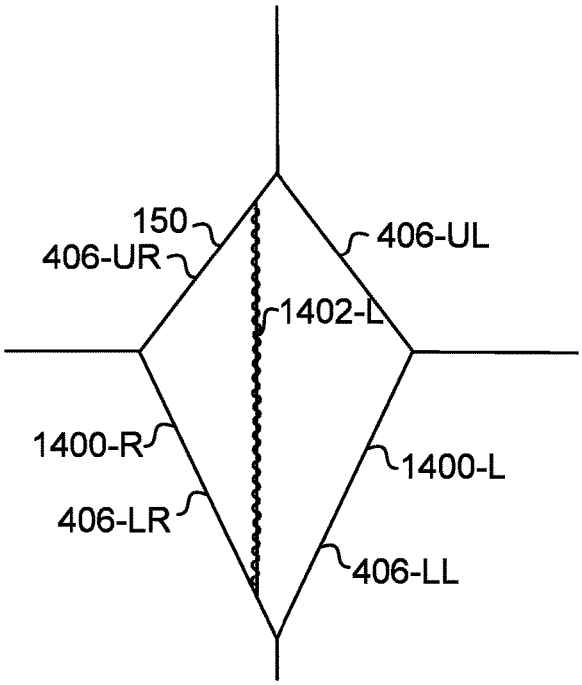
FIG. 14 is a front view of a third variation of a crotch portion of an embodiment.
Figure 15:
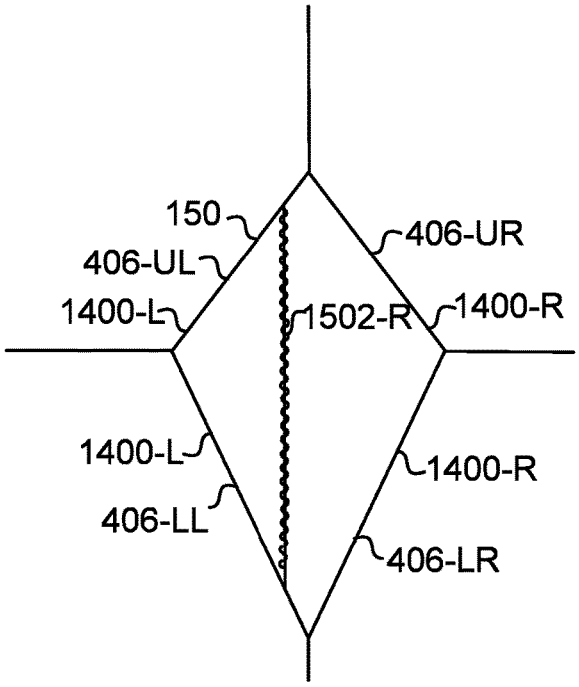
FIG. 15 is an inside view of the third variation of a crotch portion of an embodiment.

FIG. 14 is an outside view of the crotch portion 150 attached to another embodiment of a left crotch panel 1400-L and a right crotch panel 1400-R. FIG. 15 is an inside view of the crotch portion 150 attached to left crotch panel 1400-L and right crotch panel 1400-R.

The left crotch panel 1400-L includes a free edge 1402-L that extends from upper right 406-UR to lower right 406-LR. Left crotch panel 1400-L and right crotch panel 1400-R overlap such that the external vaginal area of the user is between free edges 1402-L, 1502-R. The free edge 1502-R of right crotch panel 1400-R is not visible from the outside. A majority of the area of the crotch panels 1400-L, 1400-R do not overlap one another. The length to width ratio of each panel 1400-R, 1400-L is approximately 6:2.

The crotch panels 1400-L, 1400-R bias to a closed position such that the crotch portion 150 will not open during everyday activities such as walking or sitting. The free edges 1402-L, 1502-R of the crotch panels 1400-L, 1400-R are sufficiently close to the center such that crotch portion 150 is capable of being opened large enough for medical examination purposes, for example, inserting a speculum, or conducting a fertility treatment procedure.

The forces 302-$F_R$, 302-$F_L$ pressing against an inserted speculum would not be in direct opposition; however, the forces 302-$F_R$, 302-$F_L$ are not sufficient to dislodge a speculum or cause a torque in the speculum that would discomfort the patient. Thus, a patient may wear the pants while traveling to a medical appointment, wear the pants 100 during the medical appointment, undergo an exam or treatment, and leave the medical appointment without ever having had to remove the pants 100. The patient would remained clothed during an examination, thereby making the patient feel more comfortable and relaxed during pelvic examinations and procedures.

Figure 16:
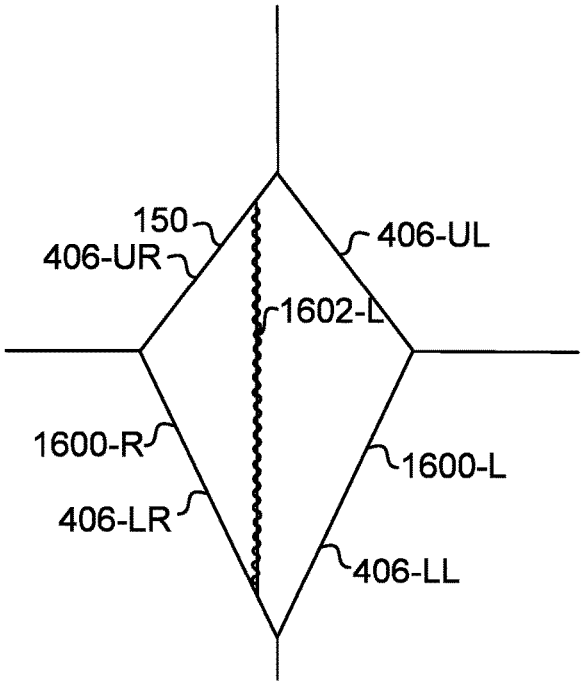
FIG. 16 is a front view of a fourth variation of a crotch portion of an embodiment.
Figure 17:
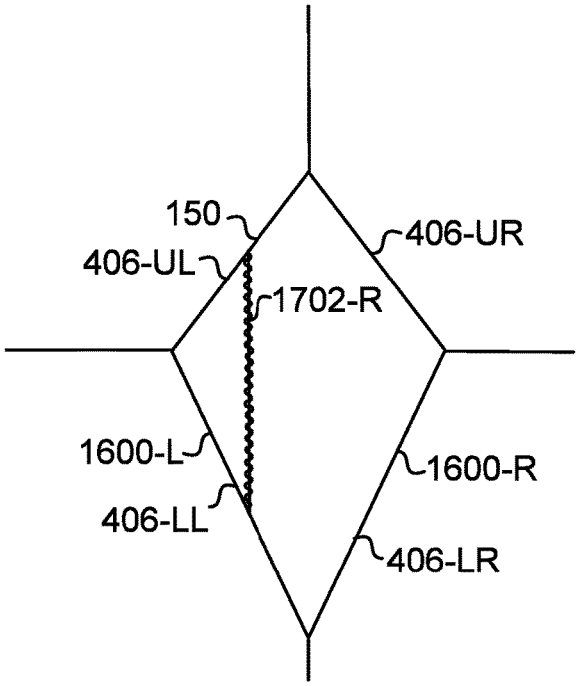
FIG. 17 is an inside view of the fourth variation of a crotch portion of an embodiment.

FIG. 16 is an outside view of the crotch portion 150 attached to another embodiment of a left crotch panel 1600-L and a right crotch panel 1600-R. FIG. 17 is an inside view of the crotch portion 150 attached to left crotch panel 1600-L and right crotch panel 1600-R. The panels 1600-L, 1600-R have different widths and are not symmetrical.

The left crotch panel 1600-L includes a free edge 1602-L that extends from upper right 406-UR to lower right 406-LR. Left crotch panel 1400-L and right crotch panel 1600-R overlap such that the external vaginal area of the user is between free edges 1602-L, 1702-R. The free edge 1702-R of right crotch panel 1600-R is not visible from the outside. A majority of the area of the crotch panels 1600-L, 1600-R do not overlap one another. The length to width ratio of the left panel 1600-L is approximately 6 to 2. The length to width ratio of the right panel 1600-R is approximately 6 to 2.5. In another embodiment, the length to width ratio of the left panel 1600-L is approximately 6 to 2.5, and the length to width ratio of the right panel 1600-R is approximately 6 to 2.

The crotch panels 1600-L, 1600-R bias to a closed position such that the crotch portion 150 will not open during everyday activities such as walking or sitting. The free edge 1602-L of the crotch panels 1600-L is sufficiently close to the center such that crotch portion 150 is capable of being opened large enough for medical examination purposes, for example, inserting a speculum, or conducting a fertility treatment procedure.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An article of clothing comprising:

a body-encircling portion having a right leg panel, a left leg panel, and a crotch portion;

said crotch portion has an outer perimeter with a first side, a second side, a third side, and a fourth side, said crotch portion includes a first crotch panel and a second crotch panel, said crotch portion is fastenerless, said outer perimeter is essentially in the shape of a kite when said article is in a relaxed configuration, such that the first side and the third side have a first length, wherein the second side and the fourth side have a second length, and wherein the second length is greater than the first length;

said first crotch panel has a free edge, said second crotch panel has a free edge;

wherein said first and second sides are entirely directly affixed to said first crotch panel, and wherein a portion of said third side and a portion of said fourth side are directly affixed to said first crotch panel, and wherein said first crotch panel free edge extends continuously from said third side to said fourth side;

wherein said third and fourth sides are entirely directly affixed to said second crotch panel, and wherein a portion of said first side and a portion of said second side are directly affixed to said second crotch panel, and wherein said second crotch panel free edge extends continuously from said first side to said second side; and wherein said first and second crotch panels are configured to bias to a closed position such that said right leg panel, said left leg panel, said first crotch panel, and said second crotch panel collectively cover a user's entire crotch area when said article is worn by the user.

2. The article of claim 1, wherein said first, second, third, and fourth sides are essentially straight when the article is in the relaxed configuration.

3. The article of claim 1, said first crotch panel is made entirely of a first material having a first grain line, wherein all panels directly affixed to said first crotch panel are made entirely of said first material having said first grain line, said right leg panel and said left leg panel are directly affixed to said first crotch panel and aligned such that any contiguous portion of said first crotch panel, said right leg panel, and said left leg panel have parallel said first grain line.

4. The article of claim 3, said first material is a combination of 92% polyester and 8% spandex.

5. The article of claim 1, said crotch portion is configured to bias to the closed position when said article is worn by the user, regardless of the leg positions of the user.

6. The article of claim 1, said crotch portion outer perimeter has only four sides.

7. An article of clothing comprising:

a body-encircling portion having a right leg panel, a left leg panel, and a crotch portion;

said crotch portion has an outer perimeter with a first side, a second side, a third side, and a fourth side, said outer perimeter is essentially in the shape of a kite when said article is in a relaxed configuration, such that the first side and the third side have a first length, wherein the second side and the fourth side have a second length, and wherein the second length is greater than the first length, said crotch portion includes a first crotch panel directly affixed to said outer perimeter and a second crotch panel directly affixed to said outer perimeter, said crotch portion is fastenerless, said crotch portion is positionable between an open position and a closed position;

said first crotch panel has a free edge, said second crotch panel has a free edge, wherein said first panel free edge extends continuously from said third side to said fourth side, wherein said second panel free edge extends continuously from said first side to said second side;

wherein said crotch portion is configured to bias to a completely closed position when worn by a user;

said first crotch panel is entirely formed of a first material, all panels directly affixed to said first crotch panel are entirely formed of said first material, said first material has a first grain line, said first crotch panel is directly affixed to said right leg panel and to said left leg panel, wherein said right leg panel, said left leg panel, and said first crotch panel are aligned such that all contiguous portions of said right leg panel, said left leg panel, and said first crotch panel have parallel said first grain lines.

8. The article of claim 7, said first crotch panel free edge is arcuate, said second crotch panel free edge is arcuate.

9. The article of claim 7, said first crotch panel free edge is straight, said second crotch panel free edge is straight.

10. The article of claim 7, said first crotch panel and said second crotch panel collectively completely cover all of said crotch portion within said outer perimeter when said article is in the relaxed configuration.

11. The article of claim 7, said first crotch panel and said second crotch panel are configured to bias to the closed position such that the user's entire crotch area is covered collectively by said first crotch panel, said second crotch panel, said first leg panel, and said second leg panel when said article is worn by the user.

12. The article of claim 7, said first crotch panel free edge is completely in front of said second crotch panel when said crotch portion is in said closed position, and said second crotch panel free edge is completely behind said first crotch panel when said crotch portion is in said closed position.

13. The article of claim 7, said first and second crotch panels are identical in size and shape.

14. An article of clothing comprising:

a body-encircling portion comprising a right leg panel, a left leg panel, a first crotch panel, and a second crotch panel, wherein said right leg panel and said left leg panel are both directly affixed to each other and to said first crotch panel and said second crotch panel;

said first crotch panel includes a first perimeter edge and a second perimeter edge, said second crotch panel includes a third perimeter edge and a fourth perimeter edge, said first, second, third and fourth perimeter edges define a crotch perimeter and define a crotch area bordered by said crotch perimeter, said first and second crotch panels are completely inside said crotch perimeter;

said crotch area is fastenerless, said crotch area is positionable between an open position and a closed position, said first and second crotch panels are configured to bias to said closed position such that said first and second crotch panels collectively completely cover said crotch area;

said first perimeter edge and said second perimeter edge are each completely directly affixed to said first crotch panel, said third perimeter edge and said fourth perimeter edge are each completely directly affixed to said second crotch panel, said first and second crotch panels are identical in size and shape, said first crotch panel has a free edge that extends continuously from said first perimeter edge to said second perimeter edge, said second crotch panel has a free edge that extends continuously from said third perimeter edge to said fourth perimeter edge;

said first crotch panel is made entirely of a first material, said second crotch panel is made entirely of said first material, said right leg panel is made entirely of said first material, said left leg panel is made entirely of said first material, wherein all article panels that are directly affixed to said first crotch panel are made entirely of said first material; and said crotch perimeter is essentially in the shape of a kite with the first, second, third and fourth perimeter edges each being essentially straight when said article is in a relaxed configuration such that the first perimeter edge and the third perimeter edge have a first length, wherein the second perimeter edge and the fourth perimeter edge have a second length, and wherein the second length is greater than the first length, said crotch area is elongated along a sagittal midline of a user when worn by the user.

15. The article of claim 14, said first material is comprised of approximately 92% nylon and 8% spandex.

16. The article of claim 15, wherein all panels in said article of clothing are made of said first material.

17. The article of claim 14, said crotch area biases to the closed position when worn by the user regardless of the leg positions of the user.

* * * * *